US005513714A

United States Patent [19]

Downie et al.

[11] Patent Number: 5,513,714

[45] Date of Patent: May 7, 1996

[54] STABILIZATION DEVICES FOR DRILL MOTORS

[75] Inventors: Andrew M. Downie, Dunfermline; Roy Powell, Banchory, both of Scotland

[73] Assignee: Neyrofor-Weir Limited, Alloa, Scotland

[21] Appl. No.: 10,130

[22] Filed: Jan. 28, 1993

[30] Foreign Application Priority Data

Jan. 31, 1992 [GB] United Kingdom ..... 9202163

[51] Int. Cl.[6] ..... F21B 7/08

[52] U.S. Cl. ..... 175/76; 175/325.2

[58] Field of Search ..... 175/61, 73, 76, 175/107, 325.2, 325.3

[56] References Cited

U.S. PATENT DOCUMENTS

| | | | |
|---|---|---|---|
| 3,561,549 | 2/1971 | Garrison et al. | 175/76 |
| 4,040,495 | 8/1977 | Kellner et al. | 175/73 |
| 4,185,704 | 1/1980 | Nixon, Jr. | 175/76 |
| 4,396,234 | 8/1983 | Garrett | 175/325.2 |
| 4,501,336 | 2/1985 | Kemp et al. | 175/61 |
| 4,526,241 | 7/1985 | Anders | 175/76 |
| 4,664,206 | 5/1987 | Butler | 175/325.2 |
| 4,667,751 | 5/1987 | Geczy et al. | 175/76 X |
| 4,694,914 | 9/1987 | Obrecht | 175/61 |
| 4,697,651 | 10/1987 | Dellinger | 175/61 |
| 4,817,740 | 4/1989 | Beimgraben | 175/76 |
| 4,874,045 | 10/1989 | Clayton | 175/325.2 |
| 4,880,066 | 11/1989 | Steiginga et al. | 175/75 |
| 5,180,021 | 1/1993 | Champion et al. | 175/76 |
| 5,273,123 | 12/1993 | Bardin et al. | 175/74 |

FOREIGN PATENT DOCUMENTS

| | | | |
|---|---|---|---|
| 0085444 | 8/1983 | European Pat. Off. | E21B 7/06 |
| 0178709 | 4/1986 | European Pat. Off. | E21B 17/10 |
| 0380893 | 8/1990 | European Pat. Off. | E21B 4/00 |

*Primary Examiner*—Frank S. Tsay
*Attorney, Agent, or Firm*—Pennie & Edmonds

[57] ABSTRACT

A stabilization device for a down-hole motor for use in drilling operations for example in oil-fields to control any tendency for spiralling of the tool bit during the drilling action and to permit steering by a "orientate and rotate" technique. In an example of the device, an end portion of a motor shaft (26) projects from a motor body (20), the projecting portion being comprised of an attachment apparatus or bit box (28) by which a tool bit (38) is connected for rotation. The bit box (28) may be separable from the shaft (26) or may be integrally formed therewith, but, is provided with a stabiliser means (32) in the form of part-helical vanes surrounding the bit box (28). The bit (38), when secured in the box (28), is located immediately adjacent the stabilising vanes (32) for maximum control; additionally, stabiliser vanes (22,24) may be provided on the motor body portion (20) and, if required, on the selected tool bit.

11 Claims, 2 Drawing Sheets

STABILIZATION DEVICES FOR DRILL MOTORS

BACKGROUND OF THE INVENTION

The invention is concerned with improvements in or relating to stabilisation devices for drill motors, particular but not exclusively for use with downhole motors for operation in a bore.

Down-hole motors, which may be positive displacement motors, turbo-drills or any suitable motor arrangement for operation within a bore or other confined passage, are conventionally fitted with stabiliser devices to guide the motor body, shaft and drill bit in the bore. It will be understood that an un-stabilised arrangement working at operational speeds can partake of a whirling action producing a spiralling motion which can seriously reduce the drilling rate, the effect being particularly severe in the case of certain types of geological formations in which the bore is being formed.

The stabilisers conventionally used comprise a series of vanes machined with or secured to the motor body and usually the bit itself. The gaps between the vanes permits the passage of drilling fluid between the motor and the drilling area. The motor body supports a so-called bit box, a tool bit attachment-means which connects a replaceable bit to the motor shaft. In assembly the bit is secured to the box by the use of tongs which grip the box, necessitating that the latter has sufficient length to permit proper grip.

Conventionally, stabilisation of the bit may be achieved by the use of a long gauge bit, but this is not normally preferred and the bits are more usually provided with stabilising vanes similar to those on the motor body. Even in this case, the introduction of a vaned stabiliser on the bit necessarily increases the distance by which the bit projects beyond the motor bit box adversely affecting stress levels in the tool.

Moreover, in the use of downhole motors, it is conventional practice to control the progress of drilling on a path including portions having changes of direction, by using the so-called "orientate and rotate" technique. This is achieved by providing the motor body with an arcuate or inclined portion so that the body housing has a bend built in to it, or to provide an in-line housing with eccentric or off-set stabilisers. When it is required to drill the bore in a straight line, the drill string is rotated while the drill is operating. To continue drilling with a change of direction, the string is orientated and locked against rotation. When drilling is re-commenced the desired change of direction may then be achieved. To "steer" the motor in such a manner to obtain effective directional control and keep any reduction in drilling rate to a minimum, it is desirable to keep the distance by which the bit projects beyond the bit box as short as possible.

It will be appreciated that there is a conflict of requirements between what is advantageous for the reduction of whirling or spiralling and what is advantageous for directional control.

SUMMARY OF THE INVENTION

The invention provides in a drill motor assembly of the kind adapted for use in a bore, a stabilisation device comprising a tubular motor body portion adapted for rotational movement on a selective basis to provide a steering capability, a motor shaft passing through said tubular motor body portion to project beyond a down-hole end portion thereof, a tool bit attachment means being provided on the projecting end portion of the motor shaft, said attachment means having stabiliser means mounted thereon so as, in use, to be at least substantially adjacent to a tool bit received by said attachment means.

In use, when the tool bit is mounted upon the attachment means, the construction and arrangement is such that the distance between operating faces of the tool bit and the down-hole end portion of the motor body is minimised.

Conveniently the attachment means may comprise a tapered internally threaded portion adapted to receive an externally threaded portion of a tool bit which may be of any desired length and may be, if desired, devoid of stabilisation devices.

Advantageously, the stabiliser means mounted upon the attachment means or bit box, may comprise spaced apart vanes which may have a part-helical layout around the circumference of the bit box.

The invention provides in another of its aspects, a method of operating a drill motor assembly for use in a bore so as to improve lengthwise progress thereof within said bore, comprising securing a tool bit to an attachment means provided upon a down-hole end portion of a motor shaft said shaft being received within a tubular motor body portion so that said attachment means projects immediately beyond a down-hole end portion of the body portion, and providing around the attachment means a stabiliser means in a position immediately adjacent the motor body end portion to minimise the distance between operating faces of the tool bit and the motor body end portion, thereby preventing any excessive whirling action of the bit as it is rotated, which would detract from said lengthwise progress of the assembly in the bore.

BRIEF DESCRIPTION OF DRAWINGS

There will now be described two examples of stabilisation means according to the invention. It will be understood that the description, which is to be read with reference to the drawings, is given by way of example only and not by way of limitation.

In the drawings.

DETAILED DESCRIPTION OF DRAWINGS

Figure 1:
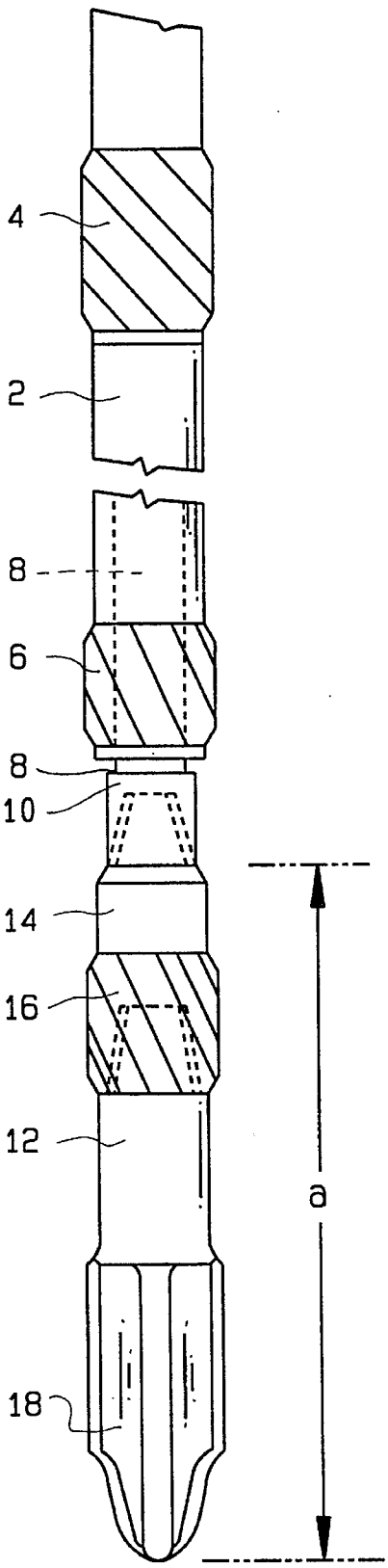
FIG. 1 Prior Art
FIG. 1 shows an example of a prior art arrangement.

The arrangement shown in FIG. 1 comprises a motor body 2 having stabilisation devices in the form of an upper and a lower set of stabilising vanes 4, 6, respectively. The lower vanes 6 act as guide means for the cutting action. Within the body 2 is a motor shaft 8 at the lower end of which is provided an attachment means 10 which is conveniently referred to as a bit box and which comprises an internally threaded portion which may be capable of receiving directly an externally threaded pin of a tool bit 12. However the desirability of providing a stabilising means at this location as explained above makes it beneficial to provide a near-bit stabiliser insert 14 having a set of stabilising vanes 16. The bit 12, which comprises a cutting portion 18 at an outer end thereof, is then inserted into the insert 14. The distance to which the cutting portion 18 projects beyond the bit box 10 is shown as a in FIG. 1.

Figure 2:
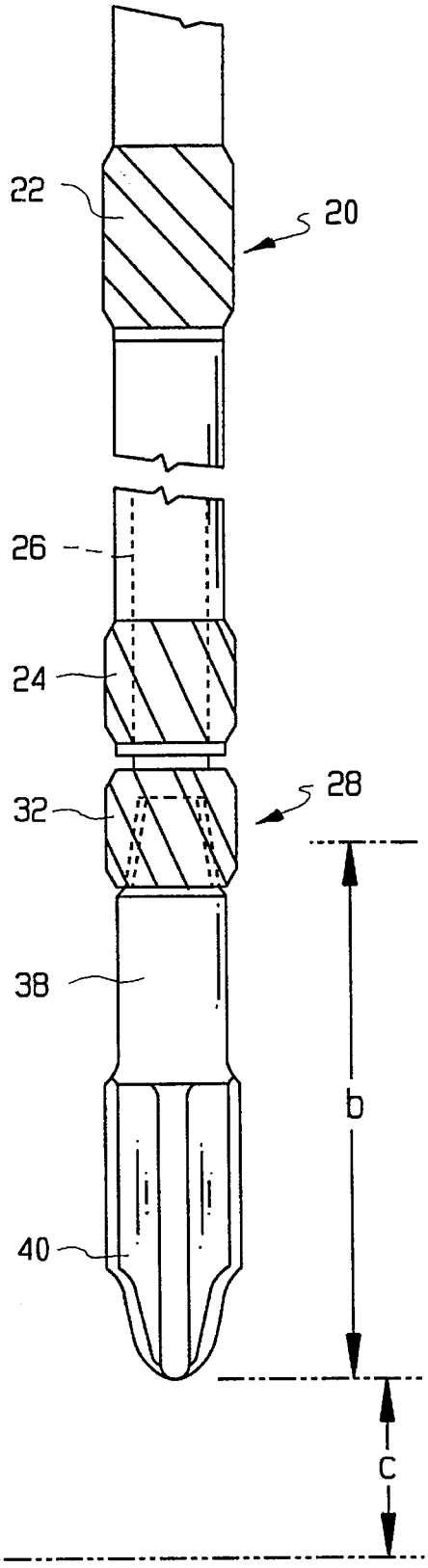
FIG. 2 is a side view of a first example of a stabilisation means and a drill motor according to the invention.
Figure 3:
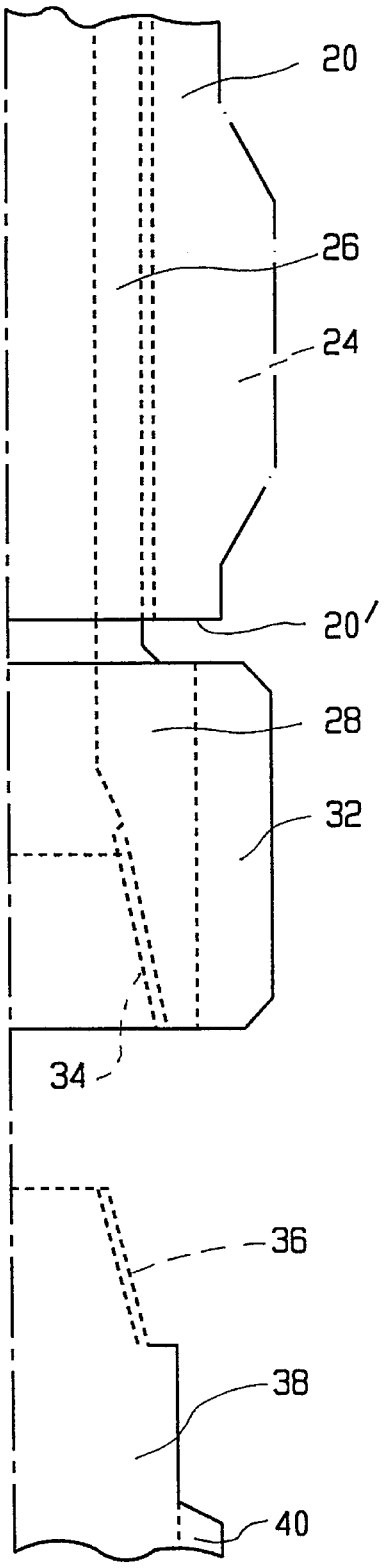
FIG. 3 is a fragmentary view of a portion of the example shown in FIG. 2.

FIGS. 2 and 3 show a first example of an arrangement according to the invention. A motor body 20 is provided with stabilising vanes 22, 24 similar to the sets of vanes 4 and 6 of FIG. 1. At a lower end of a motor shaft 26 of the motor is provided an attachment means in the form of a bit box 28 (see FIG. 3). Surrounding the box 28 is a set of projecting, circumferentially arranged part-helical vanes 32, forming a stabiliser means mounted upon the bit box 28. The bit box has a tapered, internally threaded portion 34 into which is received an externally threaded portion 36 of a tool bit 38, which is provided with a cutting portion 40. Thus it will be appreciated that the length b of the bit 38 can be kept to a minimum by reducing it in comparison with that of the bit 12 of FIG. 1 by a distance c and is selected according to operating conditions. Thus it is possible to reach an optimum situation in relation to the problems of spirally and of direction control as mentioned above.

Figure 4:
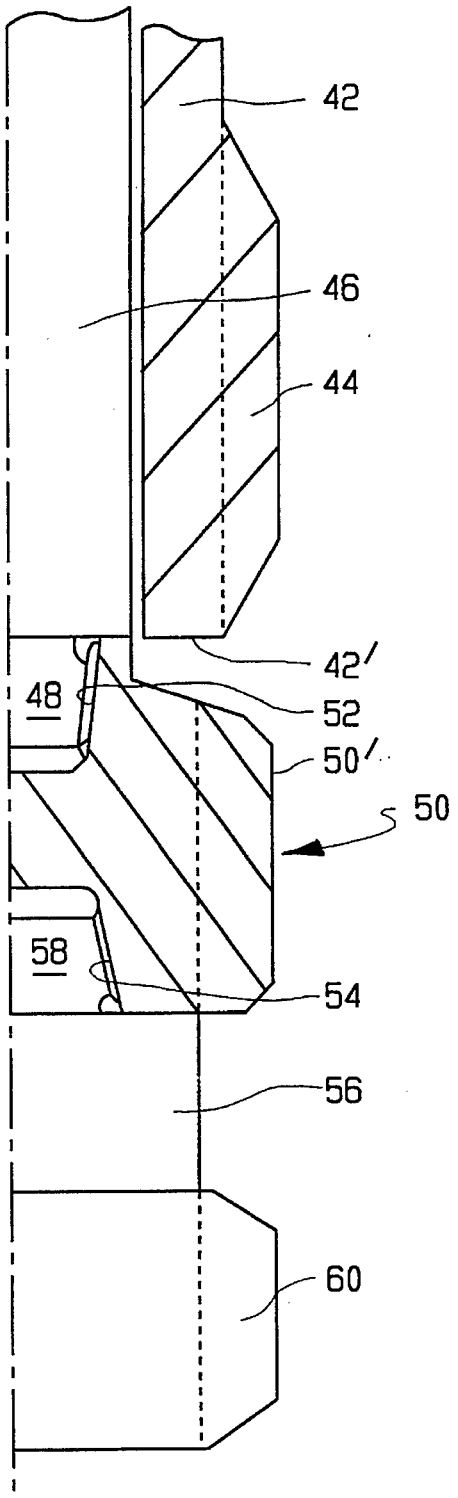
FIG. 4 is a side view, partly in section of a second example of a stabilisation means and a drill motor according to the invention.

FIG. 4 shows a second example according to the invention, in which a motor body 42 is provided with stabilising vanes 44. A further set of vanes at a higher level may be provided, the two sets corresponding to the vanes 22 and 24 in FIG. 2. At the lower end of a motor shaft 46 is provided an externally threaded tapering pin 48 projecting beyond the body 42. An attachment member indicated at 50 comprises a first internally threaded tapered recess 52 into which is received the pin 48 and a second internally threaded tapered recess 54. A tool bit 56 is secured to the member 50 by means of a externally threaded tapered pin 58 received in the recess 54, the bit having a cutting portion 60.

Various modifications may be made within the scope of the invention as defined by the following claims.

We claim:

1. A drill motor assembly stabilization device comprising:

a tubular motor body portion having a longitudinal axis and adapted for rotational movement about said axis on a selective basis to provide a steering capability;

a rotatable motor shaft extending in a predetermined direction through said tubular body portion for rotation about a shaft axis and projecting beyond a down-hole end portion thereof;

a tool bit attachment means having opposite ends with one end attached to the down-hole end portion of the motor shaft;

stabilizer means mounted on said attachment means concentrically with respect to said shaft axis and extending from said one end to the opposite end thereof;

a tool bit attached to the opposite end of said attachment means;

wherein the attachment means has a predetermined length as measured between said opposite end and in a direction along said axis of rotation of said tubular body and comprises a cylindrical body portion having said stabilizer means projecting therefrom in the shape of vanes; and said tool bit is spaced from the down-hole end portion of the motor body by no more than the length of the attachment means.

2. A device as claimed in claim 1, wherein the vanes of the stabilizer means extend in the direction of the axis of rotation of said body and are spaced apart around the circumference of the attachment means.

3. A device as claimed in claim 2, wherein the vanes are at least partly helical in configuration.

4. A device as claimed in claim 1, in combination with a tool bit, wherein the tool bit is provided with stabilizing means adapted to act in co-operation with the action of the stabilizer means on the down-hole end portion of said motor body portion.

5. A device as claimed in claim 1 in which further stabilizer means are provided on the down-hole end portion of the motor body portion.

6. A method of operating a drill motor assembly for use in drilling in a bore so as to improve lengthwise drilling progress thereof within said bore, comprising the steps of: securing a tool bit to an attachment means provided upon a down-hole end portion of a motor shaft, said shaft being received within a tubular motor body portion so that said attachment means projects immediately beyond a down-hole end portion of the body portion; and providing around the attachment means a stabilizer means in a position immediately adjacent the motor body down-hole end portion to position the tool bit immediately adjacent said attachment means, thereby preventing any excessive whirling action of the bit as it is rotated, which would detract from said lengthwise drilling progress of the assembly in the bore.

7. A drill motor assembly stabilization device comprising:

a tubular motor body portion having a longitudinal axis and adapted for rotational movement about said axis on a selective basis to provide a steering capability;

stabilized means mounted on the down-hole end portion of the motor body portion;

a rotatable motor shaft extending in a predetermined direction through said tubular body portion for rotation about a shaft axis and projecting beyond a down-hole end portion thereof;

a tool bit attachment means having opposite ends with one end attached to the down-hole end portion of the motor shaft;

stabilizer means mounted on said attachment means concentrically with respect to said shaft axis;

a tool bit attached to the opposite end of said attachment means;

said attachment means having a predetermined length as measured between said opposite ends and in a direction along said axis of rotation of said tubular body; and said tool bit being spaced from the down-hole end portion of the motor body by no more than the length of the attachment means.

8. A device as claimed in claim 7, wherein said attachment means comprises a tapered internally threaded portion adapted to receive an externally threaded portion of a tool bit.

9. A device as claimed in claim 8, wherein said attachment means is formed integrally with the motor shaft end portion.

10. A device as claimed in claim 8, wherein said attachment means is secured to the motor shaft end portion by a screw-threaded engagement means.

11. A device as claimed in claim 10, wherein the motor shaft end portion is provided with an externally threaded pin portion and the attachment means is provided with an internally threaded recess to receive said pin portion.

* * * * *